US006478493B1

(12) United States Patent
Cepeda et al.

(10) Patent No.: US 6,478,493 B1
(45) Date of Patent: Nov. 12, 2002

(54) WAX-STICK HAIR REMOVAL DEVICE PRIMARILY FOR SMALL AREAS OF THE FACE AND BODY AND METHOD THEREOF

(76) Inventors: Daniel Mario Cepeda, 1420 E. California Ave., Glendale, CA (US) 91206; Patricia Calvo Cepeda, 1420 E. California Ave., Glendale, CA (US) 91206

( * ) Notice: Subject to any disclaimer, the term of this patent is extended or adjusted under 35 U.S.C. 154(b) by 32 days.

(21) Appl. No.: 09/651,251

(22) Filed: Aug. 30, 2000

(51) Int. Cl.[7] ..... B43K 19/00
(52) U.S. Cl. ..... 401/49; 401/2; 401/55
(58) Field of Search ..... 401/1, 2, 68, 75, 401/49, 55

(56) References Cited

U.S. PATENT DOCUMENTS 4,958,951 A 9/1990 Mann
5,076,720 A * 12/1991 Roger ..... 401/75
5,848,850 A 12/1998 Bontoux
6,086,276 A * 7/2000 Gueret ..... 401/54

* cited by examiner

*Primary Examiner*—Gregory Huson
*Assistant Examiner*—Peter deVoie
(74) *Attorney, Agent, or Firm*—Leonard Tachner

(57) ABSTRACT

A depilatory wax stick which is simple, low cost and easy to use, particularly on facial and neck surfaces and other small areas and even in delicate areas where very fine wax deposition is required. In a preferred embodiment disclosed herein, the wax stick is generally cylindrical and is about 10 cm long and has a slightly tapered shape with a 1.8 cm diameter base and a 1.5 cm diameter free end which is rounded to form about a 1.0 cm application tip. Because there is no required flow of wax through an aperture or passage or onto a roller, the stick may be shaped in virtually unlimited ways to facilitate extremely fine application control. In its simplest form, the base of the stick is held in a tapered plastic cap which provides a stable flat surface. An external housing may be provided to promote convenient storage and to prevent contamination of the wax between uses. In an alternative embodiment, the wax stick of the invention is provided in a push-up container much like a lipstick tube which may be capped to enclose the stick.

12 Claims, 3 Drawing Sheets

WAX-STICK HAIR REMOVAL DEVICE PRIMARILY FOR SMALL AREAS OF THE FACE AND BODY AND METHOD THEREOF

BACKGROUND OF THE INVENTION

1. Field of the Invention

The present invention relates generally to the removal of hair in localized, delicate areas such as facial hair above and below the lips, toes and bikini line. The invention relates more specifically to a wax-based hair removal device which employs a "stick" of wax that is hard at room temperature and that may be accurately applied to intricate regions when the end of the stick is heated to render the wax into a semi-viscous form for ease of application.

2. Background Art

The application of depilatory wax for removal of body hair is an old and well-known technology. Numerous forms of wax applicators have been disclosed in the art. By way of example, U.S. Pat. No. 4,958,951 to Mann discloses a roller-based applicator having a reservoir for heating the wax prior to dispensing it onto the skin. U.S. Pat. No. 5,848,850 to Bontoux et al refines the roller applicator by permitting the roller to be configured in a variety of different dispensing widths to vary the size of the band of wax applied by the roller.

Unfortunately, such prior art depilatory wax applicators tend to be relatively complex and thus too costly for the ultimate consumer who nevertheless, needs a hair removal applicator having fine control for delicate and intricate surfaces such as for removing facial hair just above or just below the mouth. Other depilatory wax applicators which may be less complex, tend to be designed for application to large body surfaces such as the thighs where fine delicate control of the wax deposition is less important than it would be on the face and neck areas.

Thus, there appears to be a continuing need for a depilatory wax applicator which is of a simple and low cost configuration, but which enables a user to apply a fine deposit of the wax in a small, localized area where delicate touch and control is more important than quantity and speed of application.

SUMMARY OF THE INVENTION

The present invention meets the aforementioned continuing need by providing a depilatory wax stick which is simple, low cost and easy to use on facial and neck surfaces and even in delicate areas such as toes and bikini lines where very fine wax deposition is required. In a preferred embodiment disclosed herein, the wax stick is generally cylindrical and is about 10 cm long and has a slightly tapered shape with a 1.8 cm diameter base and a 1.5 cm diameter free end which is rounded to form about a 1.0 cm application tip. Of course, a key feature of the preferred embodiment is that because there is no required flow of wax through an aperture or passage or onto a roller, the stick may be shaped in virtually unlimited ways to facilitate extremely fine application control. Thus, for example, the overall diameter of the stick could be readily reduced or alternatively, the degree of tapering could be altered to provide a smaller tip without modifying the base diameter. Moreover, the shape of the tip could be readily modified to provide a lipstick shape (i.e., ogive terminating in a point).

In its simplest form, the base of the stick is held in an optional tapered plastic cap which provides a stable flat surface. An external housing may be provided to promote convenient storage and to prevent contamination of the wax between uses. In an alternative embodiment, the wax stick of the invention is provided in a push-up container much like a lipstick tube which may be capped to enclose the stick. However, it will be understood that the wax stick herein may be used without any base or holder.

Irrespective of the shape or container, the stick is used by heating the tip with a flame or other source of heat immediately prior to application of the wax until the tip surface consistency becomes soft and semi-viscous to permit deposition of the wax onto the selected surface. After the applied wax is allowed to cool and harden, it is removed with the entrained facial hair and disposed of in a suitable receptacle. Removal can be by hand, by spatula or applicator and by papers, cloths, muslin, et cetera.

OBJECTS OF THE INVENTION

It is therefore a principal object of the present invention to provide a depilatory wax device which is especially adapted to use on delicate and intricate areas.

It is another object of the invention to provide a depilatory wax application device which is of simple and low cost structure.

It is still another object of the invention to provide a hair removal wax applicator which has a relatively small diameter tip for applying wax to fine and delicate areas.

It is still another object of the invention to provide a depilatory wax applicator which comprises a wax stick extending from a cap or holder providing a grasping area for applying the wax.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENTS

Figure 1:
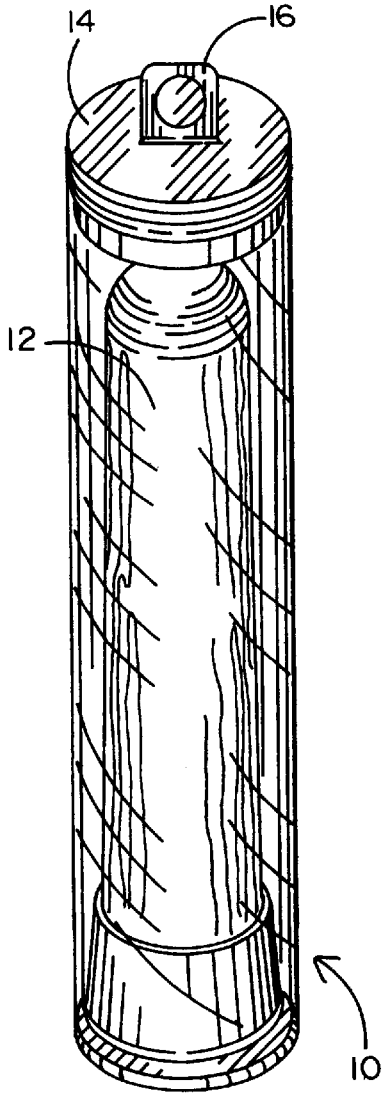
FIG. 1 is a three-dimensional view of the wax application device of the invention in a storage container.
Figure 2:
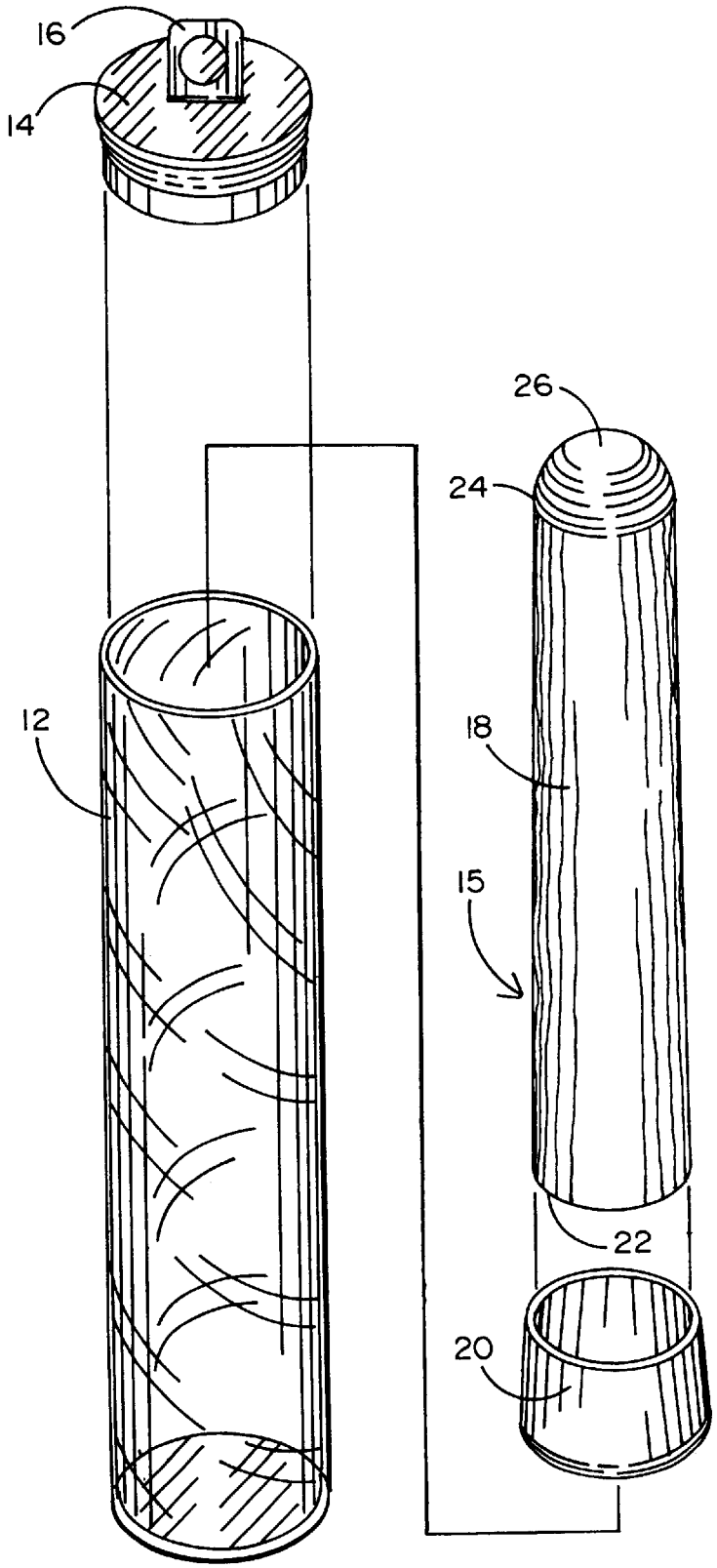
FIG. 2 is an exploded view of the wax application device of FIG. 1.

Referring to the accompanying Figures, and FIGS. 1 and 2 in particular, it will be seen that in a first embodiment a wax applicator 10 comprises a cylindrical storage case 12 enclosed by a cap 14, the latter having a handle 16 to facilitate removal of the cap from the case. The case houses an application device 15 comprising a wax stick 18 and a base 20. Wax stick 18 has a base end 22 and a free end 24, the latter terminating in a rounded tip 26.

Use of the wax applicator 10 requires removal of the application device 15 from the case 12 so that the user can grasp base 20 while applying a flame to tip 26. Once the tip 26 is heated sufficiently to become semi-viscous, the application device 15 may then be employed in the manner shown in FIG. 3.

Figure 3:
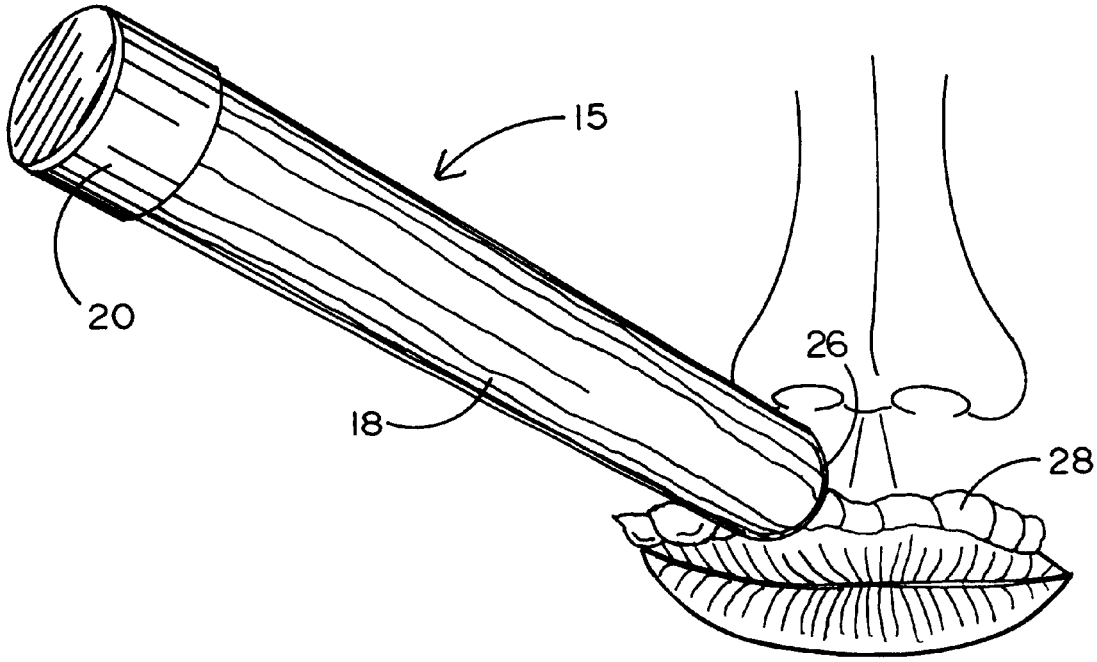
FIG. 3 is a view of the device of FIG. 1 shown being used to apply wax to the facial area between the upper lip and the nose.
Figure 4:
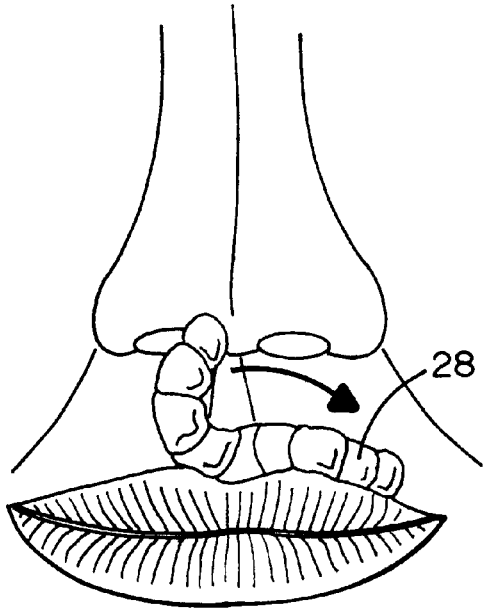
FIG. 4 is a view of the wax being removed from the facial area of FIG. 3 after application.

As shown in FIG. 3, the wax stick 18 is held at an appropriate position and angle to enable tip 26 to contact the selected delicate region such as the area between the upper lip and the nostrils. The softened tip transfers applied wax 28 to the selected area where the wax is allows to cool and harden while entraining the hair to be removed. Removal of the hair is the accomplished by either manual removal of the hardened wax 28 as shown in FIG. 4 or by other well-known techniques.

Figure 5:
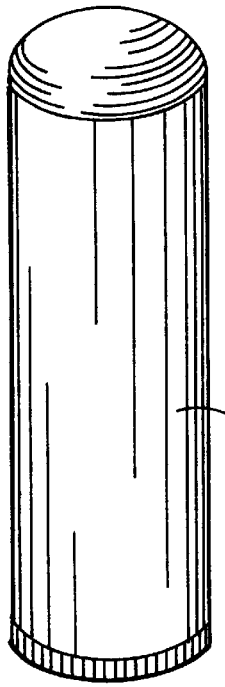
FIG. 5 is a three-dimensional view of an alternative embodiment of the wax application device of the invention.
Figure 6:
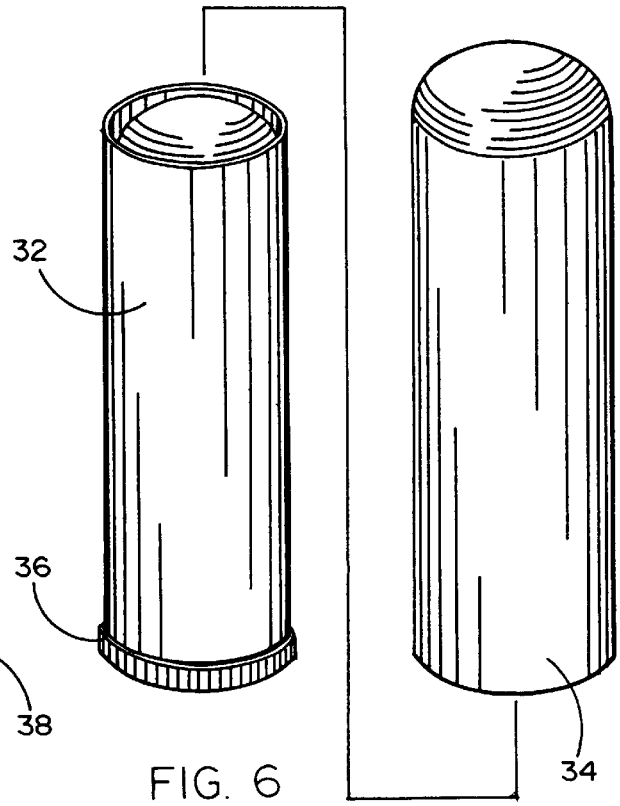
FIG. 6 is a view similar to that of FIG. 5 but showing the wax stick exposed to apply wax after a cap is removed.
Figure 7:
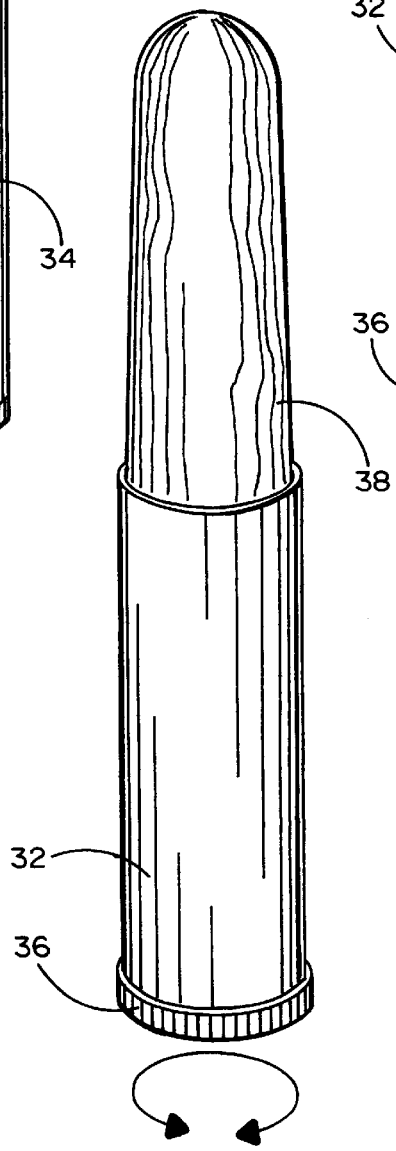
FIG. 7 is a view similar to FIGS. 5 and 6 but showing the wax stick extended.

An alternative embodiment of the invention is shown in FIGS. 5 through 7. A wax applicator 30 is provided in a cylindrical tube 32 having a cover 34. At the base of tube 32, an actuator 36 provides a pushing action to extend a wax stick 38 as seen best in FIG. 7. The actuator 36 and tube 32 operate in a manner similar to lipstick tubes, which are well known in the cosmetic art and need not be described herein in detail. Once the wax stick 38 is fully extended from tube 32 as shown in FIG. 7, the application of wax to the fine, delicate surfaces is accomplished in the same manner as shown in FIG. 3. Tube 32 then provides a convenient grasping surface for holding the wax stick during wax application.

Having thus described illustrative examples of the invention, it being understood that other embodiments are contemplated and will now occur to those having the benefit of the above disclosure, what is claimed is:

1. A wax application device for hair removal from intricate areas of the face and body, the device comprising:

a wax stick formed from an elongated, continuously tapered shaft of depilatory wax which remains solid at room temperature has a tip which is capable of being melted by heating for application.

2. The wax application device recited in claim 1 further comprising a tapered base for attachment to the stick at a base end for grasping the stick during heating and application of the wax to said intricate areas.

3. The wax application device recited in claim 1 wherein said wax stick is shaped as a tapered cylinder having a maximum diameter at said base end and having a smaller diameter free end forming a rounded tip for accurate application of said wax.

4. The wax application device recited in claim 3 further comprising an elongated cylindrical case for housing said wax stick and base when not being used to apply wax.

5. The wax application device recited in claim 4 wherein said case further comprises a removable cap for enclosing said wax stick and base within said case.

6. The wax application device recited in claim 3 wherein said maximum diameter is less than about 2 cms and wherein said tip has a dimension of about 1 cm.

7. A wax application device for hair removal from intricate areas of the face and body, the device comprising:

a wax stick formed from an elongated, continuously tapered shaft of depilatory wax which remains solid at room temperature; and a tube for receiving said stick, said tube having an external actuator for selectively extending and retracting said stick relative to said tube.

8. The wax application device recited in claim 7 further comprising a cover for enclosing said tube and said wax stick.

9. The wax application device recited in claim 7 wherein said wax stick is shaped as a tapered cylinder having a maximum diameter at said base end and having a smaller diameter free end forming a rounded tip for accurate application of said wax.

10. The wax application device recited in claim 9 wherein said maximum diameter is less than about 2 cms and wherein said tip has a dimension of about 1 cm.

11. A method for removing facial and body hair using depilatory wax; the method comprising the steps of:

a) providing a depilatory wax which is solid at room temperature;

b) molding said wax into the shape of an elongated, continuously tapered wax stick having an application tip which is comparable in size to the smallest dimension of the area from which said hair is to be removed;

c) heating said tip until said wax melts;

d) applying said melted wax to said area;

e) allowing said applied wax to cool and harden; and f) removing said cooled and hardened wax from said area.

12. The method recited in claim 11 further comprising the step of attaching a grasping device to an end of said wax stick.

* * * * *